US010131168B2

(12) United States Patent
Becker et al.

(10) Patent No.: US 10,131,168 B2
(45) Date of Patent: Nov. 20, 2018

(54) ROTARY PRINTING METHOD

(71) Applicant: MERCK PATENT GMBH, Darmstadt (DE)

(72) Inventors: Andreas Becker, Egelsbach (DE); Thomas Rathschlag, Riedstadt (DE); Johannes Tasch, Moerfelden-Walldorf (DE)

(73) Assignee: MERCK PATENT GMBH, Darmstadt (DE)

( * ) Notice: Subject to any disclaimer, the term of this patent is extended or adjusted under 35 U.S.C. 154(b) by 49 days.

(21) Appl. No.: 15/039,283

(22) PCT Filed: Oct. 28, 2014

(86) PCT No.: PCT/EP2014/002893
§ 371 (c)(1),
(2) Date: May 25, 2016

(87) PCT Pub. No.: WO2015/078550
PCT Pub. Date: Jun. 4, 2015

(65) Prior Publication Data

US 2017/0157966 A1 Jun. 8, 2017

(30) Foreign Application Priority Data

Nov. 27, 2013 (EP) ..... 13005520

(51) Int. Cl.
*B41M 1/04* (2006.01)
*B41F 5/24* (2006.01)
*B41F 31/26* (2006.01)

(52) U.S. Cl.
CPC ..... *B41M 1/04* (2013.01); *B41F 5/24* (2013.01); *B41F 31/26* (2013.01); *B41P 2200/12* (2013.01)

(58) Field of Classification Search
CPC ... B41F 31/26; B41F 5/24; B41M 1/04; B41P 2200/12
See application file for complete search history.

(56) References Cited

U.S. PATENT DOCUMENTS 3,661,081 A * 5/1972 Wright ..... B41F 5/24 101/219
5,671,678 A * 9/1997 Bolte ..... B05C 1/0808 101/491
2001/0029859 A1 10/2001 Samworth et al.
2006/0204718 A1* 9/2006 Kawakami ..... G02B 5/02 428/141

(Continued)

FOREIGN PATENT DOCUMENTS

EP 2384888 A2 11/2011
JP 2002178654 A 6/2002

OTHER PUBLICATIONS

International Search Report for PCT/EP2014/002893 dated Feb. 5, 2015.

(Continued)

*Primary Examiner* — Francis C Gray
(74) *Attorney, Agent, or Firm* — Millen White Zelano & Branigan

(57) ABSTRACT

The present invention relates to a rotary printing process for the application of functional coatings to a print substrate, to a coated print substrate produced by the said process, and to the use thereof, in particular in the packaging sector.

14 Claims, 3 Drawing Sheets

(56) References Cited

U.S. PATENT DOCUMENTS

| | | | | |
|---|---|---|---|---|
| 2014/0245912 | A1* | 9/2014 | Ramakrishnan | B41F 5/24 101/142 |
| 2014/0248423 | A1* | 9/2014 | Ramakrishnan | H05K 3/1275 427/97.4 |
| 2015/0101745 | A1* | 4/2015 | Ramakrishnan | B41F 5/24 156/250 |
| 2015/0122138 | A1* | 5/2015 | Van Ostrand | B41F 5/24 101/216 |

OTHER PUBLICATIONS

English Abstract for EP2384888, Publication Date: Nov. 9, 2011.
English Abstract for JP2002178654, Publication Date: Jun. 26, 2002.

* cited by examiner

ROTARY PRINTING METHOD

The present invention relates to a rotary printing process for the application of functional coatings to a print substrate, to a coated print substrate produced by the said process, and to the use thereof, in particular in the packaging sector.

The various common printing processes are generally used for the printing of various print substrates with a visible, black, white or coloured printing ink, which is applied to the print substrate in the form of characters, patterns and/or symbols. If required, however, part-areas or the entire area to be printed on the print substrate can also be fully coated with printing ink.

It is known that different printing processes are preferred for different areas of application, since the quality requirements of the printed images obtainable in each case vary just as much, depending on the range of applications of the printed material, as the print qualities achievable by means of the individual processes.

The flexographic printing process, as a further development of the letterpress printing process which was customary earlier, has already been employed for years for printed materials which are produced in mass production and are not subject to the highest quality requirements. Due to the flexible relief printing plates, which can be produced by comparatively simple and inexpensive processes, the flexographic printing process can be employed for many print substrates of different quality, extending from films via cardboard to fabrics. This makes it particularly interesting for packaging printing. Flexographic printing machines are employed today in actual flexographic printing and also in offset varnishing.

Besides the printing of a very wide variety of print substrates with colouring layers, functional layers are in the meantime also being applied to corresponding substrates with the aid of printing processes.

Functional layers are taken to mean coatings which, besides their properties which are visible under normal conditions, also have further functionalities, such as, for example, magnetic properties, electrically conducting or dissipating properties, UV light- or IR light-absorbent or -reflective properties or luminescent properties under diverse conditions.

In order to be able to maintain the desired functionality over the entire coated area, a certain layer thickness of the respective functional layer is generally necessary. Printing processes which are also able to supply the requisite layer thicknesses owing to the peculiarities of the respective printing technique are therefore selected for the application of functional layers. Preference is given here to the use of conventional gravure printing processes or also screen printing processes, with which comparatively high layer thicknesses can be obtained, depending on the viscosity of the printing ink.

Thus, for example, DE 693 16 346 T2 describes an antistatic film which has a coating comprising flake-form pigments which are provided with an electrically conducting layer comprising a doped metal oxide. The surface coating of the film can be carried out by impregnation of the film, conventional coating processes, such as a knife-coating process, or also by printing. A particular printing process or details in this respect are not described.

DE 10 2005 002 059 A1 discloses a wood material having a dissipative surface. A sheet-like wood material here is given a surface coating which consists of a synthetic resin containing electrically conductive particles. The application of the synthetic resin layer is generally carried out by impregnation, but can also be carried out via a gravure printing device.

There is in the meantime an increased demand specifically for electrically conductive or electrically dissipative coatings on various substrates. Sensitive modern electronic components of a very wide variety of types are increasingly frequently protected with the aid of their packaging against unintended damage which may arise during transport or during storage due to sudden discharge of electrical charge that has previously built up. This discharge process may proceed completely unnoticed and result in damage or even complete destruction of the electronic components. For this reason, packaging materials, such as cardboard, paper or films, are provided, with the aid of coating or vapour deposition processes, with thin functional layers which provide the surface of these materials with a certain electrical conductivity or dissipation ability and have electrical resistances in the range from $10^{10}$ to $10^{4}$ ohm.

In order to achieve a layer thickness of the functional layer which is necessary for good dissipation ability, the packaging materials are usually coated with electrically conductive layers in a separate coating step, before printing with an inscription or pattern. This considerably increases the complexity for the production of suitable packaging, since in-line printing of the substrates is not possible. In attempting to use conventional flexographic printing processes with standard parameters for the application of electrically conductive layers to cardboard, it has hitherto only been possible to obtain electrical resistances of a maximum of $10^{7}$ ohm, which are usually inadequate for the desired electrical dissipation ability of the packaging. The reason for this is inadequate layer thicknesses and cracks in the coating within the layer. It has hitherto only been possible to compensate for these deficiencies by complex multiple repetition of the printing process.

The object of the present invention therefore consists in providing a rotary printing process with the aid of which various print substrates, in particular those having a rough, absorptive surface, can be provided in a single working step with a functional coating which has no flaws and has a sufficiently great layer thickness in order to maintain the respective functionality over the entire printed area.

A further object of the invention consists in providing a print substrate having a functional coating which is produced by the said process.

In addition, an object of the invention consists in indicating the use of print substrates coated with functional layers in this way.

The object of the present invention is achieved by a rotary printing process for the application of a coating to a print substrate (12), where cells (6) arranged on a rotating anilox roll (3) are filled with a printing ink (4) in a filling step and the printing ink (4) from the cells (6) of the anilox roll (3) subsequently wets front faces (13) of screen dots (10) in a wetting step, where the screen dots (10) have front faces (13) and lateral surfaces (14) adjacent thereto and are arranged on a flexible printing plate (9) attached to a rotating plate cylinder (8), and where, in a transfer step, the print substrate (12) is pressed radially against the printing plate (9) by a rotating impression cylinder (11) and the printing ink (4) is transferred to the print substrate (12), where the printing ink comprises a functional material and at least 50 percent of the screen dots (10) on the printing plate (9) dip into the cells (6) of the anilox roll (3) during the wetting step, where, besides the front faces (13), the lateral surfaces (14) of the screen dots (10) are also wetted with the printing ink (4).

The object of the present invention is also achieved by a print substrate having a functional coating which has been produced by the rotary printing process indicated above.

In addition, the object of the present invention is also achieved by the use of a print substrate having a functional coating produced in this way, in particular in packaging materials, labels, antistatic materials, decoration materials, in security applications, for laser marking, as magnetic element or as lighting element.

The present invention accordingly relates to a rotary printing process according to claim 1.

The rotary printing process according to the invention is a rotary printing process in which one or more flexographic printing machines are usually employed. In particular, it is a flexographic printing process in the true sense or an offset varnishing process.

A conventional flexographic printing process in accordance with the prior art, with the aid of which a coating is to be applied to a print substrate, is generally carried out in accordance with the following steps:

In a filling step, cells (6) arranged on a rotating anilox roll (3) are filled with a printing ink (4) and the excess printing ink is wiped off by means of a doctor blade (7). In a wetting step, the printing ink (4) from the cells (6) of the anilox roll (3) subsequently wets the front faces (13) of screen dots (10) which are arranged on a flexible printing plate (9) attached to a rotating plate cylinder (8). Besides the front faces (13), the screen dots (10) also have lateral surfaces (14) adjacent thereto. In the printing ink transfer step, the print substrate (12) is then pressed radially against the printing plate (9) by a rotating impression cylinder (11) and the printing ink (4) is transferred from the front faces (13) to the print substrate (12). The printing ink is subsequently dried or solidified in another manner.

The functional principle of a conventional flexographic printing process is described in FIG. 1. The rotary printing process in accordance with the present invention also proceeds in principle correspondingly. The arrows denote the direction of rotation of the respective rolls. Details of a printing plate with screen dots are depicted in FIG. 2.

The wetting of screen dot front faces with printing ink by means of an anilox roll in accordance with the prior art is shown by FIGS. 4 and 5.

In general, the rules of thumb that the line count of the anilox roll should be at least a factor of 5.5 greater than the line count of the printing plate (the printing roll) in order that flaws in inking and/or Moirë phenomena are avoided, and that the scoop volume of the anilox roll should be about double the desired application of ink to the print substrate generally apply to flexographic printing processes, irrespective of whether the print substrate is to be printed over the entire area or with characters and/or patterns (see H. Kippan, ed., Handbuch der Printmedien [Manual of Print Media], Springer Verlag Berlin, 2000, p. 416).

These rules of thumb represent the prerequisites for achieving a highquality print result.

Following these rules, the uptake of ink by the screen dots from the cells (4) of the anilox roll (3) takes place as depicted in FIGS. 4 and 5, namely via exclusive wetting of the front faces (13) of the screen dots, from which the printing ink (4) is later transferred directly to the print substrate (12). These rules continue to be valid for the printing of various print substrates with purely colouring layers.

However, it has been found that following of the above-mentioned rules in the case of the application of functional coatings with the aid of a rotary printing process using a flexographic printing machine does not result in the desired success to an unrestricted extent, since, in particular in the case of absorptive print substrates, such as, for example, cardboard of all types, and in the case of printing inks which comprise functional pigments, the layer thickness of the printed layer applied to the print substrate and the concentration of the functional pigments in this printed layer are not sufficient in order to establish the desired functionality and to maintain it over the entire printed area.

Surprisingly, it has now been found that the printing of print substrates with functional layers can be simplified and the quality and functionality of the layers obtained can be significantly improved if the above-mentioned rules of thumb are contravened and the screen dot size and thus the line count of the printing roll is designed in such a way that, besides the front faces of the screen dots, the lateral surfaces of the screen dots, which are directly adjacent to the front faces, are also wetted on contact of the printing plate with the anilox roll (the wetting step). This is ensured (for 50 percent of the screen dots) through at least 50 percent of the screen dots having such small dimensions, relative to the cells of the anilox roll, that they dip into the cells of the anilox roll during the wetting step.

The lateral surfaces of the screen dots dipping in are partly or completely (10 to 100% of the respective lateral surface) wetted with the printing ink, depending on the immersion depth and progress of the printing operation. This additional wetting of the lateral surfaces of the screen dots effects more complete emptying of the cells during the wetting operation, so that the printing ink located in the cells is emptied to the extent of more than the approximately 50 percent of the scoop volume which is otherwise usual, and the colour separation is shifted in favour of the printed layer to be applied. For the same scoop volume of the cells, a greater layer thickness, compared with the prior art, can thus be transferred to the print substrate.

Whereas a layer thickness increased in this way would result in overinking or colour overlap effects in conventional colour printing processes, it ensures, on application of functional layers, that it is possible to apply printed layers having a sufficient layer thickness which are designed in a coherent manner over the entire printed area, have no flaws and have a sufficiently high functionality at all points of the printed area. This is particularly advantageous in the case of highly absorptive print substrates, such as paper (coated or uncoated), card, kraft paper, kraft liner and various other cardboard materials, as well as in the case of woven and nonwoven fabrics, in the case of which the solvents usually present in the printing ink often penetrate very quickly into the print substrate, and merging of the individual print dots to form extensive layers is thus made more difficult. If the functional printing inks comprise functional pigments, an increased layer thickness application results in the concentration of the functional pigments per unit area being sufficiently high in order to be able to ensure the functionality of the entire printed layer at each point of the layer. In the case of a flexographic printing process which is carried out with the parameters usual to date, this cannot be ensured universally owing to the technologically limited pigment volume concentration in the printing ink and the layer thicknesses in the region of a few microns (2-5 μm, preferably 2-3 μm), which are very low anyway in the case of a flexographic printing process.

In accordance with the invention, it is advantageous that at least 70 percent of the screen dots of the printing plate dip into the cells of the anilox roll during the wetting operation, so that their lateral surfaces are wetted with printing ink in addition to the front faces.

It goes without saying that either, for a constant plate line screen (line screen of the printing plate), the size of the cells of the anilox roll is adjusted in accordance with the invention in such a way that at least 50% of the screen dots of the printing plate are able to dip into the cells, or that, for a constant line screen of the anilox roll, the line screen of the printing plate is adjusted correspondingly. In order to reduce the screen dot size for a given line count of the printing plate, it is often also sufficient to reduce the area coverage of the screen dots in such a way that the screen dots are able to dip into the cells of the anilox roll. Regions having equal to or less than 50% area coverage of the screen dots for a given line count of the printing plate have proven particularly advantageous. If a choice of anilox rolls and printing plates in different line screens in each case is available, only the corresponding rolls matched to one another in their respective line screens can be employed in accordance with the invention. If, by contrast, corresponding rolls or printing plates have to be produced afresh, it is advisable to manufacture a new, correspondingly adapted printing plate, since the flexible printing plates for a flexographic printing process can be produced significantly more simply and inexpensively than the corresponding anilox rolls.

Although it is not absolutely necessary for carrying out the process according to the invention, it proves advantageous for the cells of the anilox roll to have the same shape and size over the entire area of the anilox roll. Which of the conventional production processes is used to engrave the cells is unimportant here. All anilox rolls produced by standard processes, i.e. by etch engraving, mechanical engraving or laser engraving or laser direct engraving, have proven suitable. The shape of the cells obtainable here is different in each case. Whereas mechanically engraved cells have the shape of an inverted pyramid, see FIG. 3, etched and laser-engraved cells have a round cross section. The latter, due to their cylindrical shape, also overall allow a larger scoop volume and a greater immersion depth of the screen dots and are therefore preferred for use in the process according to the invention.

In accordance with the invention, the cell width, which is determined from the diameter of round cells or the smallest side edge length of mechanically engraved cells, is denoted by W.

In a similar manner as for the cells of the anilox roll, it is advantageous, in the case of the screen dots of the printing plate employed in accordance with the invention, for the size and shape of the screen dots to be the same over the entire screened area of the printing plate. This simplifies the dipping of a multiplicity of screen dots into the cells of the anilox roll. The screen dots generally have a round cross section. The size of the screen dots, which corresponds to the diameter of the front face, is in accordance with the invention denoted by G. It is possible to use all flexographic printing plates produced by the standard processes, which can have a single- or multilayered structure and may consist of various materials (rubber, elastomers, photopolymers).

In accordance with the invention, the ratio G/W (screen dot size of the printing plate/cell width of the anilox roll) has a value in the range from 0.05 to 0.80, preferably a value in the range from 0.15 to 0.60. This means that the size of the screen dots is, in accordance with the invention, only in the range from 5 to 80%, preferably from 15 to 60%, of the cell width. The dipping of a large number of the screen dots present on the printing plate into the cells of the anilox roll is thus facilitated.

The proportion of the printed area on the print substrate relative to the total printable area of the print substrate can vary depending on the type of functional coating desired in each case. The screening on the printing plate is selected depending on the proportion of the area to be printed on the print substrate. If only part-areas of the print substrate are to be provided with the functional coating, screening on only a part-area of the printing plate is also necessary. The proportion of the surface of the printing plate provided with a screen is therefore generally between 5 and 100 percent of the total surface, preferably between 30 and 100 percent. In particular, the proportion of the surface of the printing plate provided with a screen is in some embodiments of the present invention 100 percent of the surface of the printing plate.

The printing plates employed in the process according to the invention and also the anilox rolls used preferably have a line count in the range from 34 lines/cm (34 l/cm) to 60 lines/cm (60 l/cm). Printing plate and anilox roll preferably each have the same line count.

In accordance with the invention, a functional material is regarded as being a material which, besides the properties which are visible under normal conditions (light in the visible wavelength range, atmospheric pressure and ambient temperature), also has other optical, magnetic or electrical properties. It is preferably a material which is magnetisable, electrically conducting, electrically semiconducting, electrically dissipating, UV-absorbent, UVreflective, IR-absorbent, IR-reflective, beam-splitting or, on incidence of light of defined wavelengths, luminescent.

Thus, the printing ink employed in accordance with the invention may comprise or consist of, for example, functional polymers.

The functional polymers employed are, for example, liquid-crystalline polymeric materials, which, as cholesteric materials, not only appear in different colours in the visible wavelength range under various viewing angles (optical variability), but, due to their selective light reflection in polymerised form, can also be employed as beam splitters or polarising filters. By contrast, nematic liquid-crystalline materials can only be rendered optically visible with the aid of a polarising filter. The only material-restricting factor here, besides the desired functional properties, is the establishment of a suitable printing viscosity, which has to be matched to the printing process according to the invention, which works with conventional flexographic printing machines, and the ability of the applied coating to solidify rapidly after completion of the printing operation.

Functional polymers in the sense of the present invention are, however, also electrically conductive polymers, which can likewise be employed in printable form (liquid or in a solvent dispersion or suspension) in the printing inks used in accordance with the invention. Use can be made here of all known electrically conductive polymers which, in monomeric or polymeric form, can be printed with the aid of a flexographic printing process and are subsequently either polymerised during curing or only have to be dried.

However, the printing ink employed in accordance with the invention may also comprise functional pigments and at least one binder.

The additional use of a solvent, which may consist of water and/or the conventional organic solvents or solvent mixtures used for printing processes, is in some cases advantageous, but not vital, since many binder systems which can be employed in flexographic printing processes are radiationcuring and the additional use of solvents is therefore completely or partly obsolete.

Organic solvents which can be used are branched or unbranched alcohols, aromatic compounds or alky esters, such as ethanol, 1-methoxypropanol, 1-ethoxy-2-propanol, ethyl acetate, butyl acetate, toluene, etc., or mixtures thereof.

Suitable binders are binders which are generally conventional for coating compositions, in particular those based on nitrocellulose, polyamide, acrylic, polyvinybutyral, PVC, PUR, or suitable mixtures thereof. Particular preference is given to binders on a UV-curing basis (free-radical or cationically curing). These binders or binder mixtures are preferably transparent after curing of the coating, but may also be translucent or opaque. Binders which can be employed are also the functional polymers mentioned above, which may, in addition to their own functionality, also comprise functional pigments having the same or a different functionality.

Functional pigments in accordance with the present invention are, in particular, electrically conductive pigments, electrically semiconducting pigments, magnetisable pigments, UV light-absorbent or -reflective pigments, IR light-absorbent or -reflective pigments, pigments which luminesce on incidence of light of defined wavelengths, and/or liquid-crystalline pigments.

The pigments employed may also be multifunctional, for example absorb UV light and emit visible light or reflect IR light and have optical variability in the visible wavelength range. They may have an isotropic or anisotropic shape, depending on the functionality and composition.

In general, the pigments of the type described above that are known from the prior art can be employed. Thus, magnetisable pigments consist, for example, of magnetite, maghemite or magnetisable metal alloys or have layers thereof. UV absorption or UV reflection or IR absorption or IR reflection can be achieved, inter alia, by means of interference pigments whose layer structure and layer thickness construction is set precisely to the desired conditions.

Electrically conductive or electrically semiconducting pigments are particularly preferably employed in accordance with the invention. These may consist of metal particles, such as, for example, silver particles, copper particles, iron turnings, steel particles, but also of non-metallic particles, such as graphite, conductive black, particles of conductive polymers, particles which consist of conductive metal compounds or of non-metallic substrates which are sheathed by electrically conductive compounds.

The non-metallic substrates are preferably particles of natural or synthetic mica, talc, sericite, glass, $SiO_2$, $Al_2O_3$ or $TiO_2$ which have a coating comprising a conductive material, in particular of metal oxides or metal oxide mixtures, which are generally doped with foreign atoms.

The metal oxides are preferably tin oxide, zinc oxide, indium oxide and/or titanium oxide, preferably tin oxide, indium oxide and/or zinc oxide. The said metal oxides are present in doped form in the conductive coating, where the doping can take place with gallium, aluminium, indium, thallium, germanium, tin, phosphorus, arsenic, antimony, selenium, tellurium, molybdenum, tungsten and/or fluorine. Individual dopants of those mentioned, but also combinations thereof, may be present in the conductive layer. Preference is given to the use of aluminium, indium, tungsten, tellurium, fluorine, phosphorus and/or antimony for doping of the metal oxides. The proportion of the dopants in the conductive layer can be 0.1 to 30% by weight, it is preferably in the range from 2 to 15% by weight.

In a particularly preferred embodiment, the conductive layer employed comprises doped tin oxides. These are preferably doped with indium, tungsten, tellurium, fluorine, phosphorus and/or antimony. Particular preference is given to the use of antimony-doped tin oxide, antimony- and tellurium-doped tin oxide or tungsten-doped tin oxide. However, tin-doped indium oxide, aluminium-doped zinc oxide or fluorine-doped tin oxide can advantageously also be employed. Most preference is given to the use of antimony-doped tin oxide.

In a particularly preferred embodiment of the present invention, use is made of functional pigments which have a substrate comprising natural or synthetic mica, talc or $TiO_2$ and a coating comprising antimony-doped tin oxide.

Such pigments either have an isotropic shape, so that the pigments have approximately equal measurements in all three dimensions and are in the form of grains, granules, spheres, etc., as, for example, in the case of $TiO_2$ substrates, or have an anisotropic shape, in the case of which the pigments exhibit a preferred spatial alignment and are, for example, in the form of fibres, rods, needles, cylinders, flakes or the like. The latter is the case, in particular, in the case of electrically conductive pigments which have substrates comprising mica flakes, talc flakes, sericite flakes, $SiO_2$ flakes, glass flakes or $Al_2O_3$ flakes. These are preferably and particularly successfully employed in the process according to the invention and are commercially available, for example under the name Minatec® in various variants from Merck KGaA, Germany.

Electrically conductive pigments having a similar structure or also those having semiconducting properties are also commercially available from other companies.

If the pigments are in anisotropic form, they usually have an aspect ratio (ratio of the average diameter to the average particle thickness) of at least 2 and preferably of at least 5. The aspect ratio can vary in a broad range and can be up to 250, preferably up to 100.

The size (longest measurement in one dimension, i.e. greatest length or greatest diameter) of the anisotropic electrically conductive pigments is not crucial per se, but must be matched to the anilox roll employed. The measurement of the pigments in length or width is usually from 1 to 200 μm, in particular from 5 to 125 μm, preferably from 1 to 60 μm and very particularly preferably from 1 to 25 μm. The thickness of the pigments is in the range from 0.01 to 5 μm, in particular between 0.05 and 4.5 μm and particularly preferably between 0.1 and 1 μm. Pigments having an isotropic shape which have diameters in the size range from 1 to 200 μm can also be employed in the process according to the invention.

The orders of magnitude mentioned here for pigments having an isotropic or anisotropic shape also apply to all other functional pigments mentioned above which have functionalities other than electrical conductivity.

For use of pigments having an anisotropic shape, but also of pigments having an isotropic shape, the basic principle generally applies that the pigments used in the printing process according to the invention are selected so that the width W of the cells on the anilox roll will correspond to at least 1.5 to 2 times the longest measurement of the pigments. Otherwise, defects would occur in the emptying behaviour of the printing ink from the cells during the wetting step.

The concentration of the functional pigments in the printing ink comprising them is in accordance with the invention between 5 and 45 percent, based on the solids content of the printing ink, in particular between 15 and 35 percent. In the case of a pigment content of less than 5 percent, based on the solids content of the printing ink, the functionality of the coating cannot be ensured over the entire printed region or is under certain circumstances not detectable at all. By contrast, pigment concentrations of greater than 45 percent result in clogging of the cells on the anilox roll and in emptying difficulties during wetting of the screen dots. The production run behaviour in the printing process would consequently also be adversely affected. For this reason, pigment concentrations beyond the said range are not advantageous.

The print substrate used in the process according to the invention can in principle be any print substrate which is suitable for a rotary printing process using a flexographic printing machine, i.e. films, cardboard and woven or non-woven fabrics of a wide variety of types. However, the process according to the invention proves to be particularly advantageous in the case of print substrates which consist of a cellulose-containing material or have a surface to be printed comprising cellulose-containing material. In particular, this is uncoated paper, coated paper, card, kraft paper or kraft liner. These materials generally have a rough surface and have a certain absorbency, which, although generally facilitating rapid drying or solidification of the printed coating, may, however, result in the deficiencies already mentioned above in the case of printing with functional coatings using a conventional flexographic printing process. These deficiencies can be reduced or prevented in an advantageous manner by the printing process according to the invention.

The coating comprising the functional material to the print substrate can be applied either to the uncoated print substrate, as is the case, for example, in the case of uncoated paper, card or kraft liner, but can also be applied to a print substrate which has already been pre-treated or pre-coated (for example in the case of coated or colour pre-coated paper). In addition, the print substrate already printed with the functional layer in accordance with the invention can also be overprinted with further layers, for example with colouring layers, patterns, motifs or the like.

The present invention also relates to a print substrate having a functional coating which is produced by the rotary printing process described above.

As has already been described above, a print substrate of this type comprises, in the sense of the present invention, substrates of various types which have been printed with a functional coating by means of a flexographic printing device, but preferably uncoated paper, coated paper, card, kraft paper or kraft liner which has a UV or IR light-absorbent or -reflective coating, an electrically conductive coating, an electrically semiconducting coating, an electrically dissipative coating, a magnetisable coating and/or a luminescent coating.

Particular preference is given to uncoated paper, coated paper, card, kraft paper or kraft liner which has an electrically conductive coating, an electrically semiconducting coating or an electrically dissipative coating.

The compositions and functional properties of print substrates and coating, including the constituents present therein, have already been described in detail above. To this extent, reference is made here to the above description.

The present invention likewise relates to the use of an above-described print substrate a functional coating in packaging materials, labels, antistatic materials, decoration materials, in security applications, for laser marking, as magnetic element or lighting element.

The process according to the invention enables, with the aid of a simple, adapted flexographic printing process and conventional equipment, coherent functional coatings to be produced in a single process step on print substrates, in particular on print substrates having a rough and absorptive surface, which have the desired functionality over the entire printed area and have a sufficiently high layer thickness in order to ensure a sufficiently high pigment concentration per unit area of printed area, even in the case of pigment-containing printing ink. The process according to the invention can therefore advantageously be employed for the printing of various types of print substrates using a comparatively favourable flexographic printing process, which is of particular importance, in particular, for long print runs and in packaging printing. If, as is particularly advantageous in accordance with the invention, the printing ink employed is a printing ink which comprises electrically conductive pigments, it is possible to produce in only one working step electrically conductive, electrically dissipative or electrically semiconducting layers on print substrates, which, in particular in antistatic packaging of various types, give rise to such good conductivity or dissipation ability of the packaging material that a single packaging unit is sufficient in order to protect, for example, electronic components against sudden discharge. A further additional, dissipative secondary packaging is thus superfluous. At the same time, the process according to the invention can be incorporated into conventional packaging printing processes without major additional effort, so that additional inconvenient and expensive coating operations can also be omitted.

The invention will be explained below with reference to examples, but is not intended to be restricted thereto. The explanation, as already in the descriptive part above, makes reference to the following drawings:

BRIEF DESCRIPTION OF FIGS.

EXAMPLE 1

Figure 1:
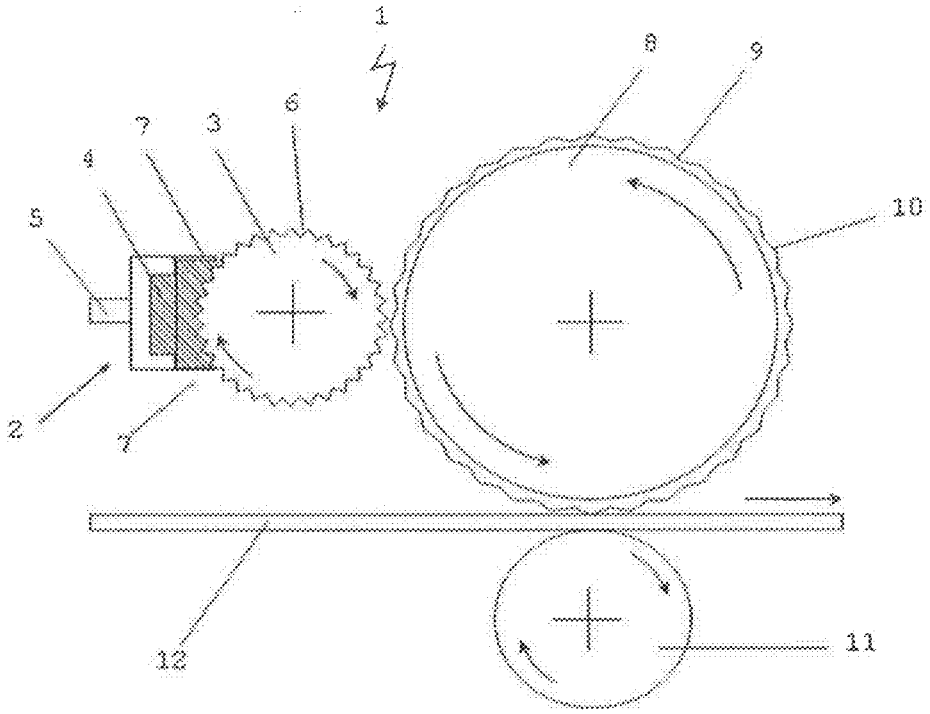
FIG. 1 shows a diagrammatic structure of a flexographic printing machine
Figure 2:
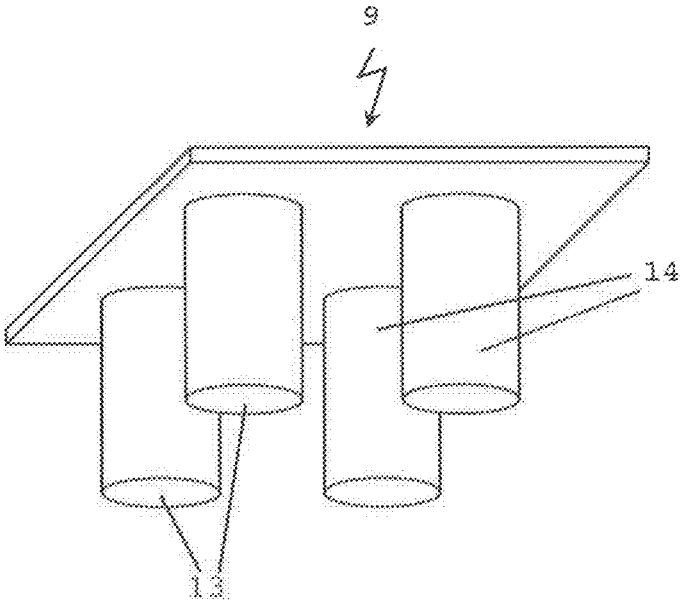
FIG. 2 shows a diagrammatic view of part of a printing plate with a number of screen dots
Figure 3:
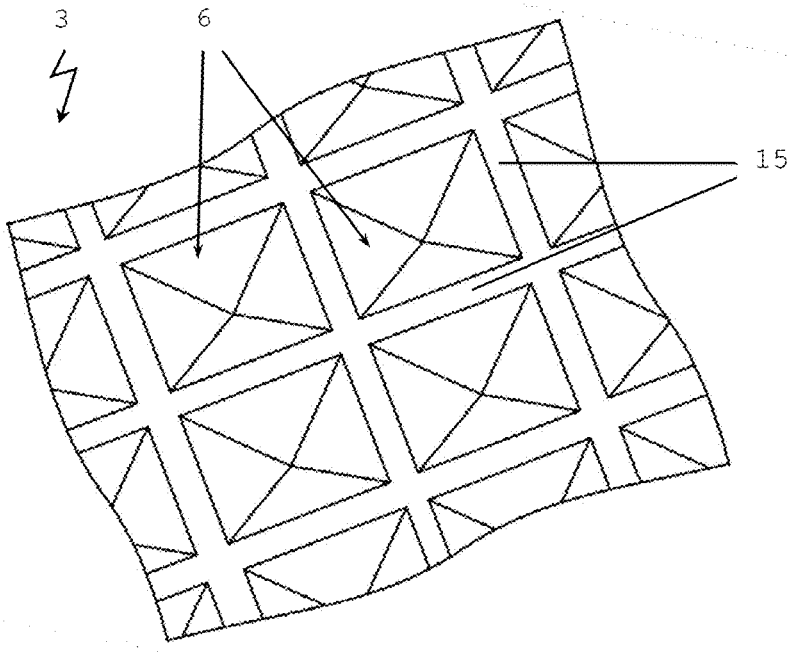
FIG. 3 shows a diagrammatic view of part of an anilox roll having a number of cells (6) (mechanically engraved) and lands (15)
Figure 4:
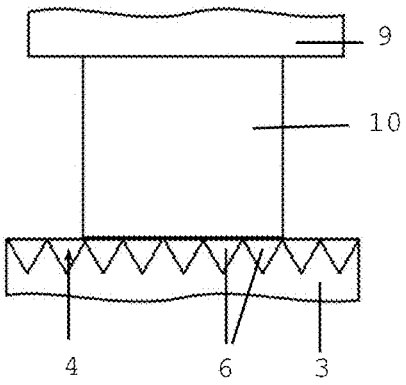
FIG. 4, 5 show a diagrammatic view of the wetting of a screen dot in accordance with the prior art FIG. 6, 7 show a diagrammatic view of the wetting of a screen dot in accordance with the invention FIG. 8, 9,10 show a diagrammatic view of the wetting and ink transfer in accordance with the invention
Figure 5:
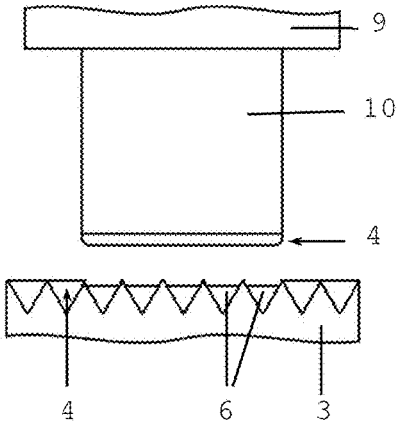
Figure 6:
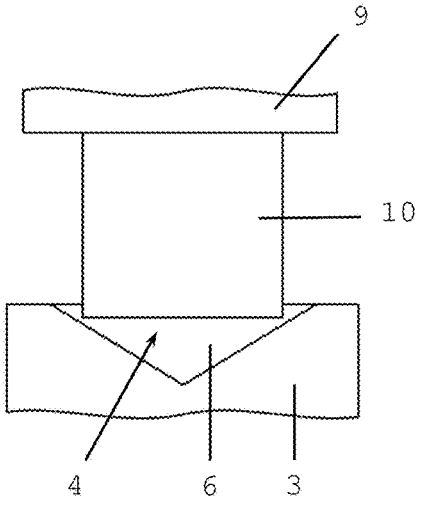
Figure 7:
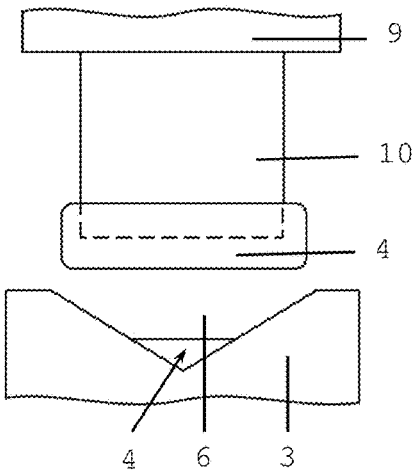
Figure 8:
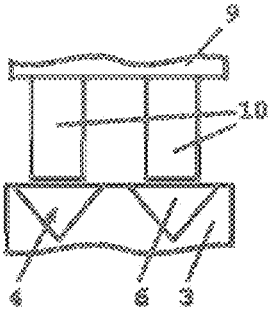
Figure 9:
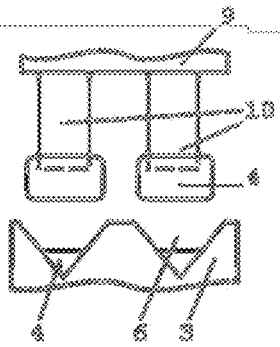
Figure 10:
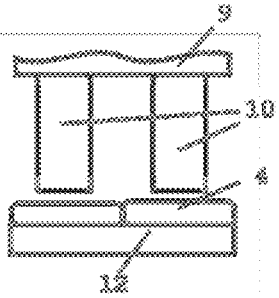

The print substrate (12) used is the pale (WK1) or dark (WK2) side of corrugated cardboard for packaging purposes (in each case kraft liner which serves as surface covering for corrugated cardboard). The viscosity of a solvent-containing printing ink (4) comprising 30% by weight of an electrically conductive pigment based on flake-form mica substrates having a coating comprising $(Sb,Sn)O_2$ having a particle size of 5-25 μm (product of Merck KGaA, Germany), and 70% by weight of a solvent-containing, binder-containing varnish (Siegwerk NC-201 from Siegwerk Druckfarben AG, solids content about 35%), is adjusted to 33 sec (4 mm efflux cup, in accordance with DIN 53211) using a mixture of ethanol and ethyl acetate 2:1. This printing ink is introduced into the inking system (2) of a flexographic printing machine via a feed device (5). The cells (6) of a rotating anilox roll (3) are brought into contact with the inking system and filled with the printing ink (4) in the process. Excess printing ink is wiped off the surface of the anilox roll with the aid of a doctor blade (7).

The anilox roll has a line count of 34 l/cm 60° (cell width W 265 μm) or 60 l/cm 60° (cell width W 129 μm).

A flexographic printing plate (9) having a line count of 34 l/cm or 60 l/cm (DuPont DEC 2.84, Tesa 52121 adhesive tape) is attached to a plate cylinder and brought into contact with the rotating anilox roll. The screen dot size G of the screen dots (10) on the printing plate (9) varies in the range from 26 μm to >275 μm (34 l/cm, 5% to 95% area coverage AC) and 10 μm to >170 μm (60 l/cm, 5% to 95% area coverage AC). The transfer of the printing ink to the print substrate (printing operation) takes place at a speed of 30 m/min. The coated print substrate is left to dry.

The electrical surface resistance of the printed cardboard is measured using a Milli TO3 ohmmeter from Fischer Elektronik. A two-point electrode with spring pressure having a contact rubber or electrode diameter of 4 mm, electrode separation 6.4 mm, spring force about 3.5 N, total pressure 7 N, is used. In the case of surface resistance values in the range $<5*10^5$ ohm the measurement is carried out at a voltage of 4 V (low), in the case of surface resistance values in the range $>5*10^5$ ohm the measurement is carried out at a voltage of 100 V (high).

Table 1 shows the electrical resistance values achieved by the coating under the respective printing conditions.

The electrical surface resistance of an unprinted corrugated cardboard is about xE+10 ohm ($x*10^{10}$).

TABLE 1

| Line screen of printing plate | Line screen of anilox roll | Size of screen dot [μm] | Electrical resistance [ohm] | G/W |
|---|---|---|---|---|
| 34 l/cm | 34 l/cm 60° | >275 (95% AC) | 2.0E+10 (WK1) | >1.04 |
| | | >275 (90% AC) | 1.0E+10 (WK1) | >1.04 |
| | | 275 (75% AC) | 1.5E+10 (WK1) | 1.04 |
| | | 201 (50% AC) | 1.0E+10 (WK1) | 0.76 |
| | | 126 (25% AC) | 9.5E+05 (WK1) | 0.47 |
| | | 90 (15% AC) | 4.3E+05 (WK1) | 0.34 |
| | | 66 (10% AC) | 1.6E+05 (WK1) | 0.25 |
| | | 40.5 (8% AC) | 1.5E+05 (WK1) | 0.15 |
| | | 26 (5% AC) | 1.8E+05 (WK1) | 0.10 |
| 60 l/cm | 60 l/cm 60° | >170 (95% AC) | 1.3E+10 (WK2) | >1.32 |
| | | 170 (90% AC) | 9.4E+09 (WK2) | 1.32 |
| | | 139 (75% AC) | 8.6E+09 (WK2) | 1.08 |
| | | 112 (50% AC) | 5.5E+09 (WK2) | 0.87 |
| | | 69 (25% AC) | 3.5E+06 (WK2) | 0.54 |
| | | 40.5 (15% AC) | 2.3E+06 (WK2) | 0.31 |
| | | 26 (10% AC) | 1.8E+06 (WK2) | 0.20 |
| | | 20 (8% AC) | 3.5E+05 (WK2) | 0.16 |
| | | 10 (5% AC) | 8.0E+05 (WK2) | 0.08 |

EXAMPLE 2

Example 1 is repeated with the modification that an aqueous printing ink (varnish: Senolith 350 298 from Weilburger, solids content about 40%, viscosity adjustment to 33 sec. using water) is used with an anilox roll line count of 60 l/cm 60° and a printing plate line count of 60 l/cm. The other conditions correspond to those from Example 1.

The results of the resistance measurement are shown in Table 2.

TABLE 2

| Size of screen dot [μm] | Electrical resistance [ohm], WK1 | Electrical resistance [ohm], WK2 | G/W |
|---|---|---|---|
| >170 (95% AC) | 1.7E+10 | 6.0E+09 | >1.32 |
| 170 (90% AC) | 1.5E+10 | 6.1E+09 | 1.32 |
| 139 (75% AC) | 7.0E+09 | 6.8E+09 | 1.08 |
| 112 (50% AC) | 7.0E+09 | 3.3E+07 | 0.87 |
| 69 (25% AC) | 1.0E+06 | 4.0E+05 | 0.53 |
| 40.5 (15% AC) | 9.5E+05 | 1.7E+05 | 0.31 |
| 26 (10% AC) | 1.8E+06 | 1.0E+05 | 0.20 |
| 20 (8% AC) | 4.3E+06 | 9.5E+04 | 0.16 |
| 10 (5% AC) | 8.0E+06 | 6.8E+04 | 0.08 |

EXAMPLE 3

On use of a coated cardboard as print substrate, it is even possible, on printing of a solvent-containing printing ink of the composition given in Example 1, to obtain electrical resistances having values of about 6E+04 with a line count of the anilox roll of 34 l/cm 60° and a line count of the printing plate of 34 l/cm at a ratio G/W of 0.34 to 0.76 (area coverage 15 to 50%), and electrical resistances having values of about 4.5E+04 with a line count of the anilox roll of 60 l/cm 60° and a line count of the printing plate of 60 l/cm at a ratio G/W of 0.08 to 0.20 (area coverage 5 to 10%).

LIST OF REFERENCE NUMERALS (1) Rotary printing machine
(2) Inking system
(3) Anilox roll
(4) Printing ink
(5) Feed device
(6) Cells
(7) Doctor blade
(8) Plate cylinder
(9) Printing plate
(10) Screen dots
(11) Impression cylinder
(12) Print substrate
(13) Front face of the screen dot
(14) Lateral surface of the screen dot
(15) Lands

The invention claimed is:

1. A rotary printing process for the application of a coating to a print substrate (12), where cells (6) arranged on a rotating anilox roll (3) are filled with a printing ink (4) in a filling step and the printing ink (4) from the cells (6) of the anilox roll (3) subsequently wets front faces (13) of screen dots (10) in a wetting step, where the screen dots (10) have front faces (13) and lateral surfaces (14) adjacent thereto and are arranged on a flexible printing plate (9) attached to a rotating plate cylinder (8), and where, in a transfer step, the print sub-strate (12) is pressed radially against the printing plate (9) by a rotating impression cylinder (11) and the printing ink (4) is transferred to the print substrate (12), characterised in that the printing ink comprises a functional material and in that at least 50 percent of the screen dots (10) on the printing plate (9) dip into the cells (6) of the anilox roll (3) during the wetting step, where, besides the front faces (13), the lateral surfaces (14) of the screen dots (10) are also wetted with the printing ink (4).

2. A rotary printing process according to claim 1, wherein the lateral surfaces (14) of the screen dots (10) are partly or completely wetted with the printing ink (4).

3. A rotary printing ink according to claim 1, wherein at least 70 percent of the screen dots (10) dip into the cells (6).

4. A rotary printing process according to claim 1, wherein the screen dots (10) have a screen dot size G and the cells (6) have a width W and the ratio G/W represents a value in the range from 0.05 to 0.80.

5. A rotary printing process according to claim 4, characterised in that the ratio G/W represents a value in the range from 0.15 to 0.60.

6. A rotary printing process according to claim 1, wherein the printing plate and the anilox roll each have a line count in the range from 34 lines/cm to 60 lines/cm.

7. A rotary printing process according to claim 1, wherein the printing plate is provided with screen dots over its entire surface.

8. A rotary printing process according to claim 1, wherein the print substrate is a cellulose-containing material.

9. A rotary printing process according to claim 8, wherein the cellulose-containing material is selected from uncoated paper, coated paper, card, kraft paper or kraft liner.

10. A rotary printing process according to claim 1, characterised in that the printing ink comprises functional polymer materials.

11. A rotary printing process according to claim 10, wherein the functional polymer materials are liquid-crystalline materials or electrically conductive polymers.

12. A rotary printing process according to claim 1, wherein the printing ink comprises functional pigments and at least one binder.

13. A rotary printing process according to claim 12, wherein the functional pigments are selected from UV or IR light-absorbent or reflective pigments, electrically conductive pigments, electrically semiconducting pigments, magnetisable pigments and/or luminescent pigments.

14. A rotary printing process according to claim 12, wherein the functional pigments have an isotropic or anisotropic shape.

* * * * *